US012723400B2

(12) United States Patent
Belville

(10) Patent No.: US 12,723,400 B2
(45) Date of Patent: Sep. 1, 2026

(54) ANCHOR BOLT APPARATUS

(71) Applicant: James Belville, Tempe, AZ (US)

(72) Inventor: James Belville, Tempe, AZ (US)

( * ) Notice: Subject to any disclaimer, the term of this patent is extended or adjusted under 35 U.S.C. 154(b) by 90 days.

(21) Appl. No.: 19/019,665

(22) Filed: Jan. 14, 2025

(65) Prior Publication Data

US 2025/0154760 A1 May 15, 2025

Related U.S. Application Data

(63) Continuation of application No. 17/984,732, filed on Nov. 10, 2022, now Pat. No. 12,227,935.

(51) Int. Cl.
*E04B 1/41* (2006.01)

(52) U.S. Cl.
CPC ..... *E04B 1/4157* (2013.01)

(58) Field of Classification Search
CPC ..... E04B 1/4157; E04B 1/2604; E04B 2001/2684
See application file for complete search history.

(56) References Cited

U.S. PATENT DOCUMENTS

| | | | | |
|---|---|---|---|---|
| 4,398,855 | A * | 8/1983 | Hultquist | F16B 13/0808 411/340 |
| 7,520,102 | B1 * | 4/2009 | diGirolamo | E04G 21/185 52/700 |
| 8,894,329 | B1 * | 11/2014 | Kekahuna | E04B 1/4157 405/259.4 |
| 10,781,844 | B2 * | 9/2020 | Kunken | F16B 5/02 |
| 11,629,743 | B2 * | 4/2023 | Kunken | F16B 13/0808 411/341 |
| 12,227,935 | B2 * | 2/2025 | Belville | E04B 1/2604 |
| 2005/0016114 | A1 * | 1/2005 | Thompson | E04C 5/16 52/698 |
| 2014/0154028 | A1 * | 6/2014 | Pei | F16B 13/0808 411/345 |
| 2023/0160197 | A1 * | 5/2023 | Belville | E04B 1/4157 52/295 |
| 2025/0154760 | A1 * | 5/2025 | Belville | E04B 1/4157 |

* cited by examiner

*Primary Examiner* — Andrew J Triggs
(74) *Attorney, Agent, or Firm* — Bruce A. Lev

(57) ABSTRACT

An improved anchor bolt apparatus that includes a rotating blade at one end and may also include a removable viewing box on the opposite end that are adapted to allow a J-Bolt to be replaced from the outside of a building without the need of cutting drywall or any exterior siding. Furthermore, the removable box may be used to allow an engineer to view and certify the proper tightening of the anchor bolt securing the vertical walls and framework of the building to its foundation.

12 Claims, 8 Drawing Sheets

ANCHOR BOLT APPARATUS

CROSS-REFERENCE TO RELATED APPLICATION

The present application is related to and claims priority from prior provisional application Ser. No. 63/281,688, filed Nov. 21, 2021, and non-provisional application Ser. No. 17/984,732, filed Nov. 10, 2022, which is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to anchor bolt apparatuses for anchoring wood frames of homes to their foundation.

2. Description of the Related Art

Prior art anchor bolt apparatuses are usually formed as J-bolts and formed from steel. However, over time these steel J-bolts do corrode and expand up to five times their original diameter resulting in the breaking out of the exterior side of their respective cement foundations. When J-bolts are corroded or scaled down 20% or more of their original diameter the J-bolt is removed and replaced. To replace a J-bolt, 8"×8" holes in drywall, called windows, are cut open or the exterior siding of a home is cut out and removed to allow the nut and washer of the J-bolt to be installed. The International Building Code (IBC) requires that an engineer view the J-bolt being tightened to certify the repair work. Thus, a need exists for an improved anchor bolt apparatus to avoid the above-mentioned problems.

BRIEF SUMMARY OF THE INVENTION

In view of the foregoing disadvantages inherent in the known types of anchor bolt apparatuses or the like in the prior art, the present invention provides an improved anchor bolt apparatus. As such, the general purpose of the present invention, which will be described subsequently in greater detail, is to provide an improved anchor bolt apparatus that includes a rotating blade at one end and a removable viewing box on the opposite end resulting and having all the advantages of the prior art and none of the disadvantages.

There has thus been outlined, rather broadly, the more important features of the invention in order that the detailed description thereof that follows may be better understood and in order that the present contribution to the art may be better appreciated. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, An Improved Anchor Bolt Apparatus, constructed and operative according to the teachings of the present invention.

The various embodiments of the present invention will hereinafter be described in conjunction with the appended drawings.

DETAILED DESCRIPTION

As discussed above, embodiments of the present invention relate to an improved anchor bolt apparatus 100 for anchoring wood frames of homes to their foundation.

Figure 3:
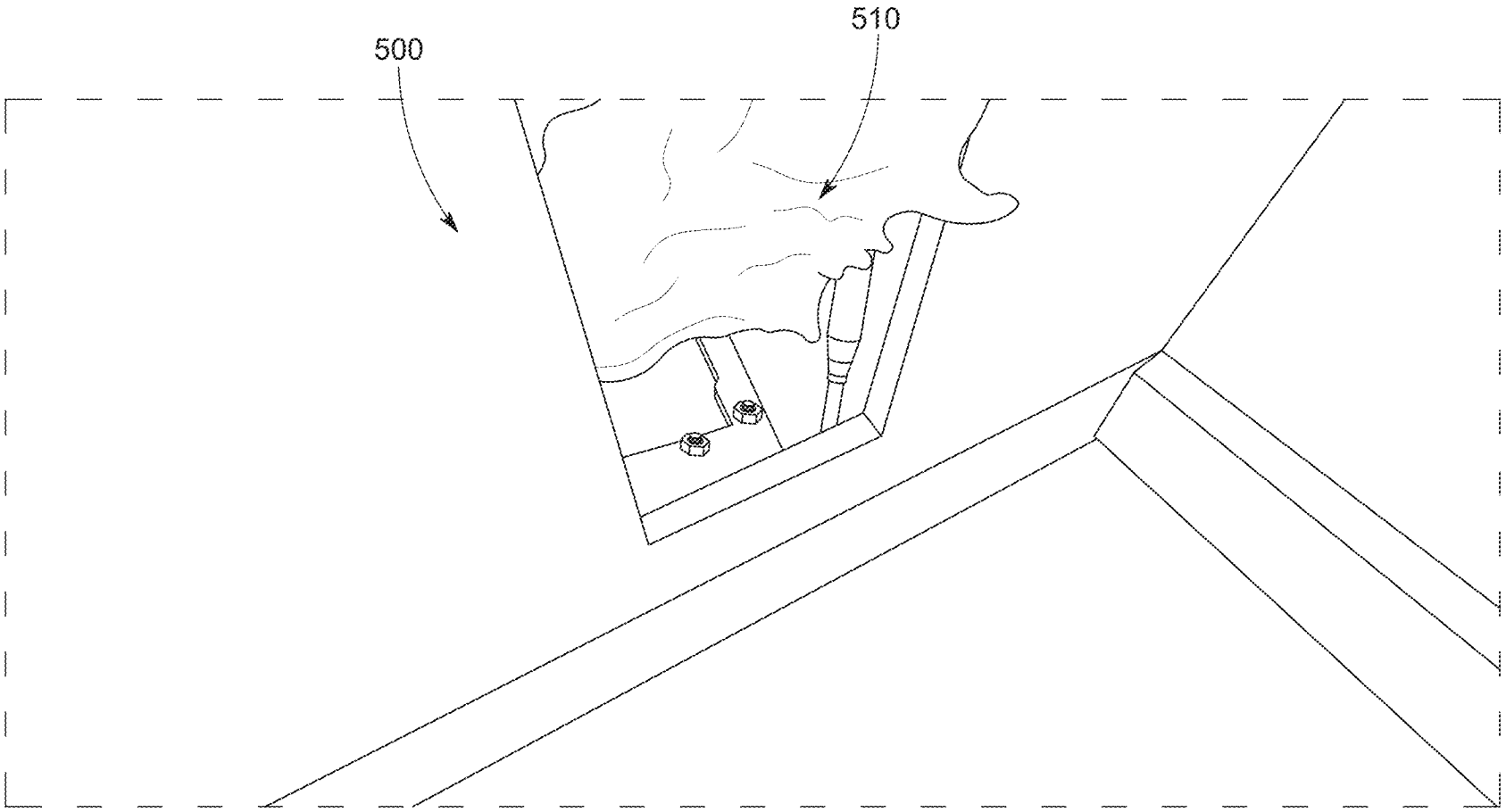
FIG. 3 shows a view of a hole (window) cut in drywall and used to access a prior art anchor bolt apparatus.

The improved anchor bolt apparatus 100 will allow a J-Bolts to be replaced from the outside of a building at the location of repair without the need for cutting drywall 500 and forming a window box 510, as shown in FIG. 3, or cutting any exterior siding as per the prior art apparatuses need. Because the improved anchor bolt apparatus is embedded within a structural concrete patch, a viewing box is installed within the structural patch and used to allow an engineer to view and certify the tightening of the anchor used to secure the vertical walls and framework of a building to its foundation. After tightening, the viewing box is removed and a cement patch is further applied.

Figure 1:
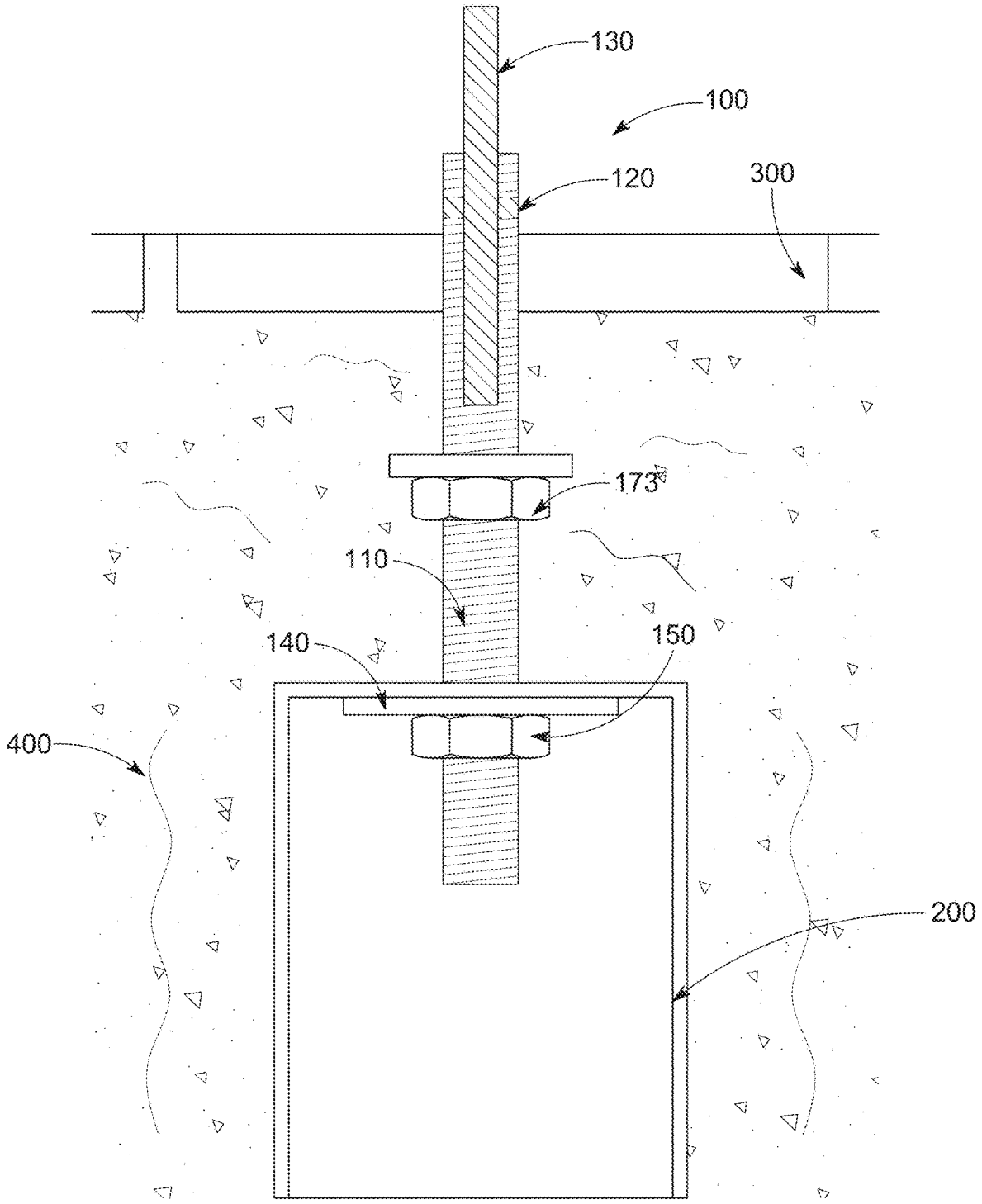
FIG. 1 shows a cut-away side view illustrating the improved anchor bolt apparatus in use according to the preferred embodiment of the present invention.
Figure 2:
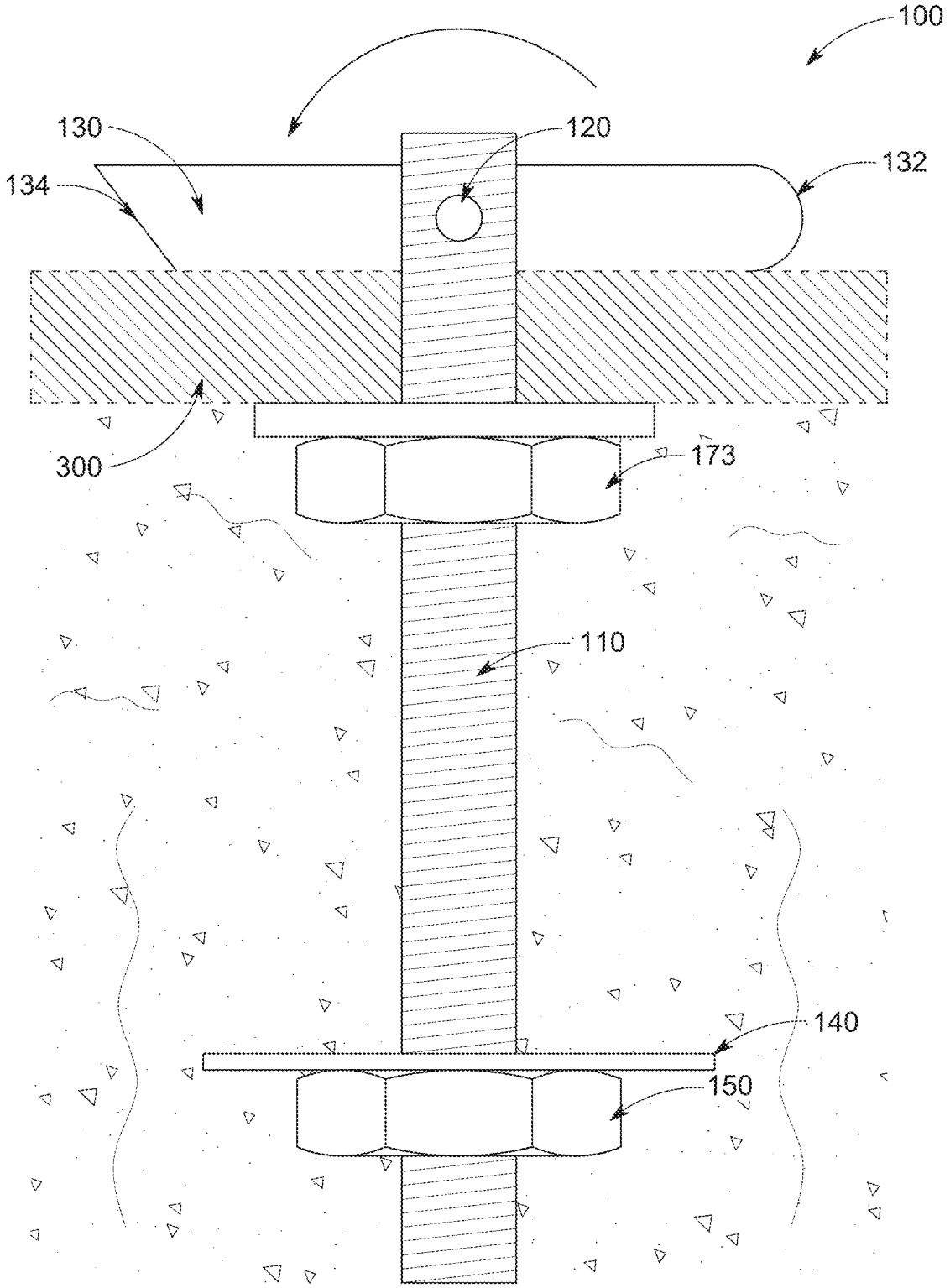
FIG. 2 shows a cut-away side view illustrating the improved anchor bolt apparatus in placed according to the preferred embodiment of the present invention of FIG. 1.

Referring now to FIGS. 1 and 2, the improved anchor bolt apparatus 100 comprises a threaded bolt 110 having an aperture therethrough at a proximal end thereof; a pin 120 placed through the threaded bolt 110; a blade 130 pivotally connected to the pin 120; a primary nut 173 adapted to be placed over and engage a mid-section of the threaded bolt 110; a washer 140 and a secondary nut 150 adapted to be placed over and engage the threaded distal end of the threaded bolt 110; and an optional viewing box 200 having an aperture therethrough adapted to allow the threaded distal end of the threaded bolt 110 to pass therethrough, wherein the blade 130 is adapted to engage a top surface of a structural member, the primary nut 173 is adapted to engage a bottom surface of the structural member, and the washer 140 and a nut 150 are adapted to engage the threaded distal end of the threaded bolt 110 and be releasably retained within the concrete of the foundation of the structure to thereby securely hold the structural member, and thereby the structure, to the foundation.

The blade 130 is placed within the aperture of the threaded bolt 110 and rotatably held in place by inserting pin 120 through the diameter of the bolt 110 and through the blade 130. Blade 130 is then allowed to freely rotate. The blade 130 allows the improved anchor bolt apparatus 100 to be inserted through an appropriately sized hole within a building structural element 300 when the blade 130 is aligned vertically. Once inserted and pulled downwardly, the blade 130 is forced to tilt/spin off its vertical position via angled edge 134 to form a T-shape, and is then secured to structural member 300 by rotating primary nut 173. Secondary nut 150 is then surrounded by concrete that forms the foundation and thereby anchors the anchor bolt apparatus 100 to the foundation 400 and thereby structural member 300 as well.

Blade 130 may be formed having an elongated flat rectangular shape having a rectangular cross-section, however, other shapes and cross sections may be used. Blade 130 may be also formed having a curved end 132 to aid the insertion of the blade into and through the hole within the building structure. Furthermore, the length of the blade 130 is larger than the diameter of the threaded bolt 110 to ensure its ability to securely contact the top surface of structural member 300.

Figure 4:
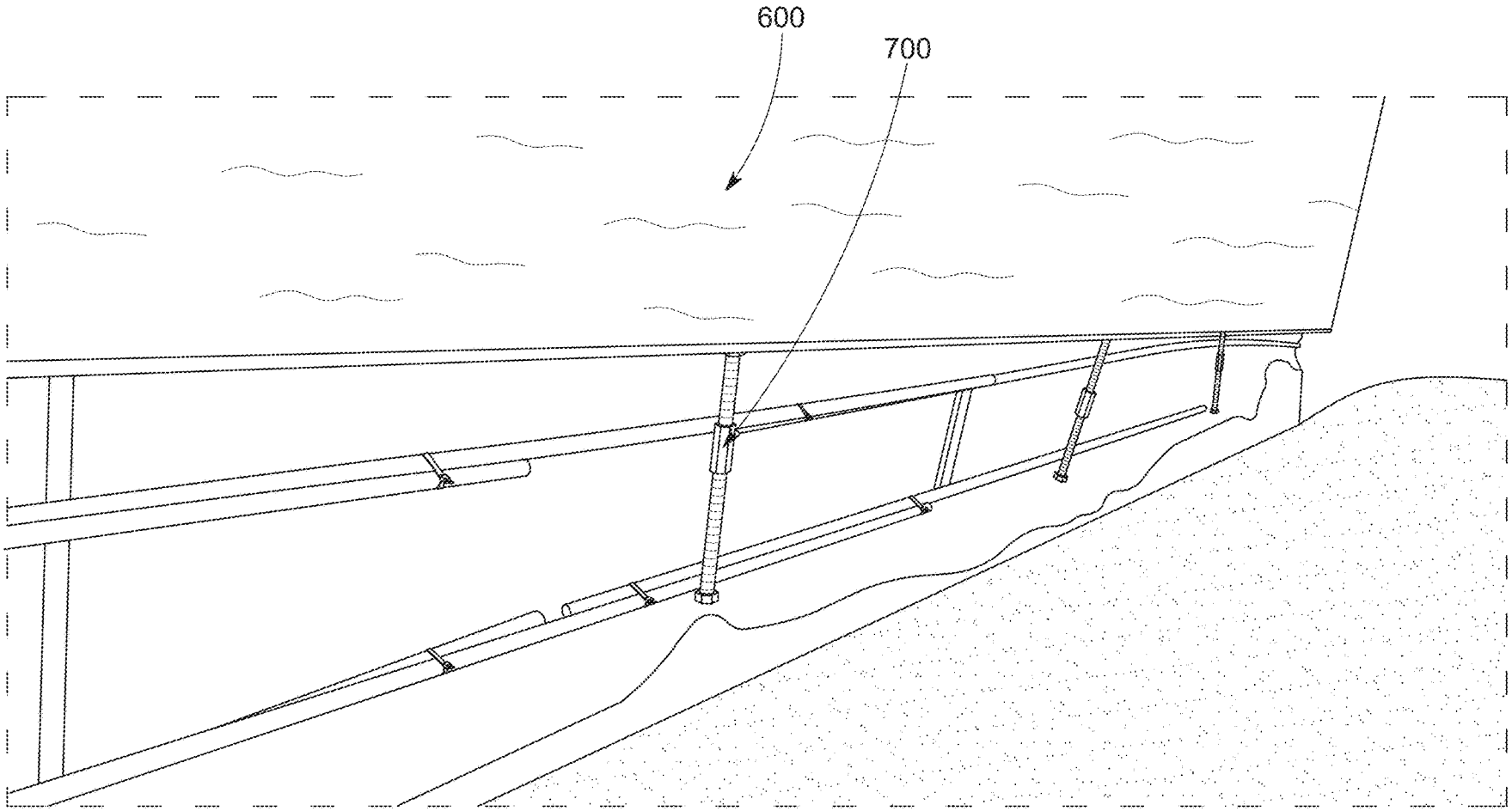
FIG. 4 shows a view of prior art shoring supports being used while a housing foundation is being repaired.
Figure 5:
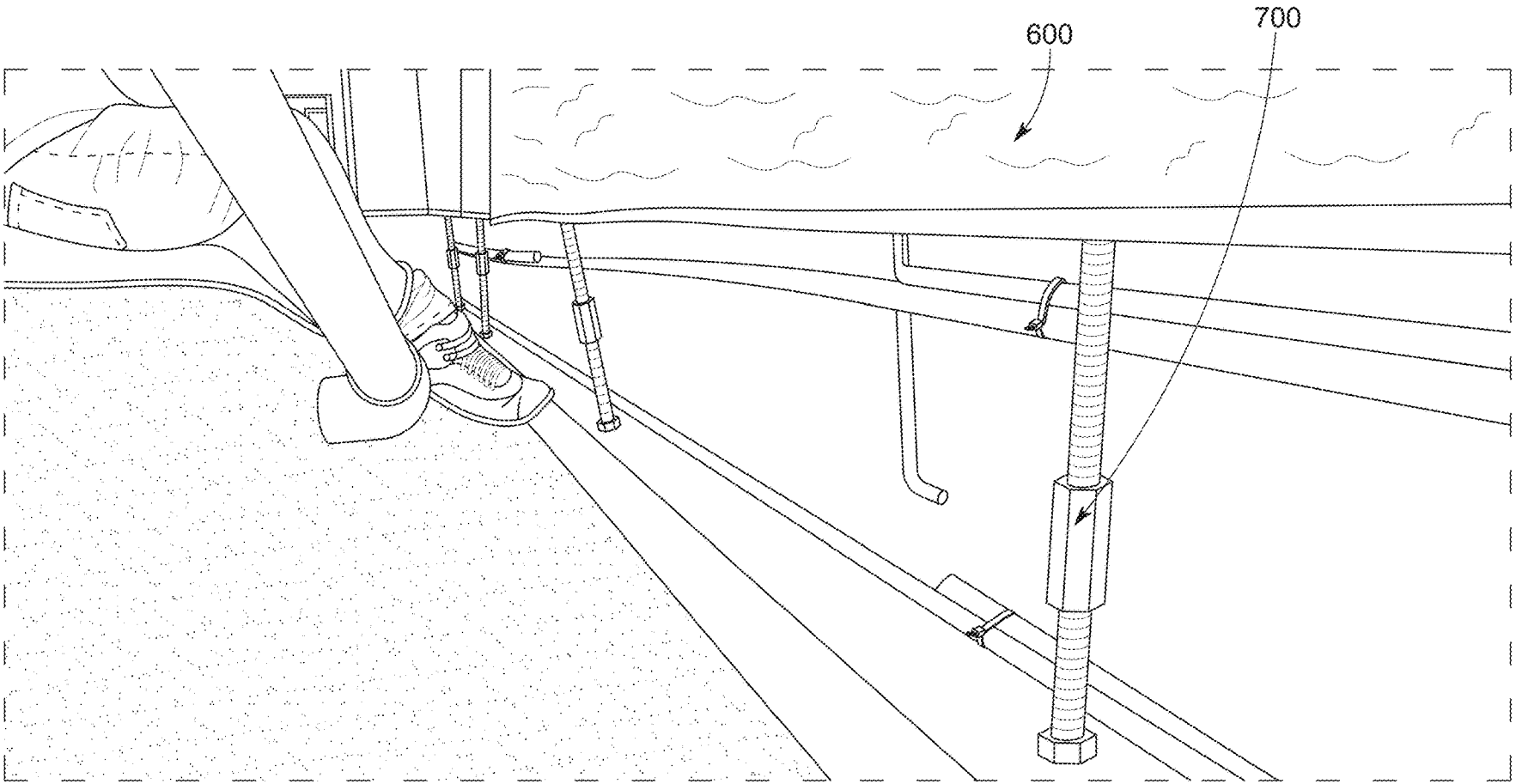
FIG. 5 shows another view of prior art shoring supports being used while a housing foundation is being repaired.

As shown in FIGS. 4 and 5, shoring supports 700 are used in the prior art while a housing foundation of a house 700 is being repaired.

When using the optional viewing box 200, the viewing box is adapted to be removably placed within the foundation of the house 700; then the threaded bolt 110 is adapted to be inserted into the aperture of the structural element 300 of the house and through the aperture of the viewing box, such that the distal end of the threaded bolt is located within the interior volume of the viewing box and the proximal end of the threaded bolt is adapted to be located above the structural element; then the blade 130 is rotated around the pin 120 and into a position adapted to engage a top surface of the structural element; then primary nut 173 is tightened, then the washer 140 and the secondary nut 150 are placed upon the distal end of the threaded bolt and tightened to create tension upon the threaded bolt, such that the house can be safely and securely attached to its foundation. After an inspector certifies the tension upon the threaded bolt, viewing box 200 may be removed and a patch of cement placed within that area to complete the process.

The viewing box 200 may be formed as one piece or multiple pieces releasably connected together. The aperture of the viewing box that is adapted to allow the threaded distal end of the threaded bolt 110 to pass therethrough may be formed as a hole of a slot. A slot makes it easier to remove the viewing box without disturbing the anchor bolt after tightening. Forming the viewing box as two or more pieces releasably connected together also allows the viewing box to be removed without disturbing the anchor bolt after tightening.

Figure 6B:
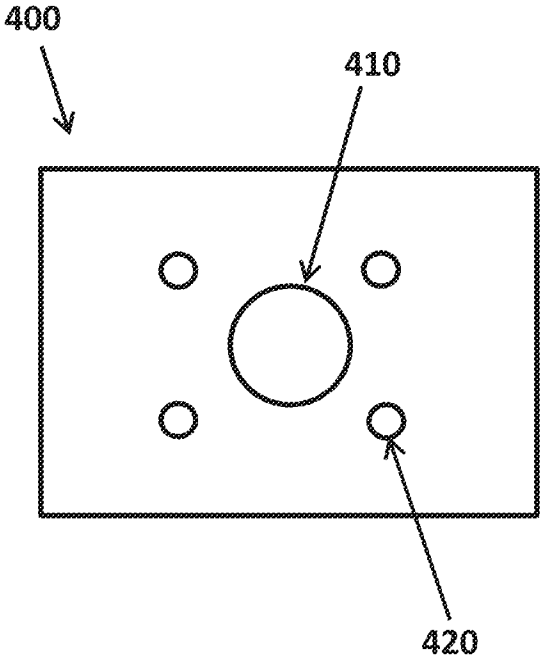
FIG. 6B shows a top view of the center plate of the alternate embodiment of FIG. 6A.
Figure 6A:
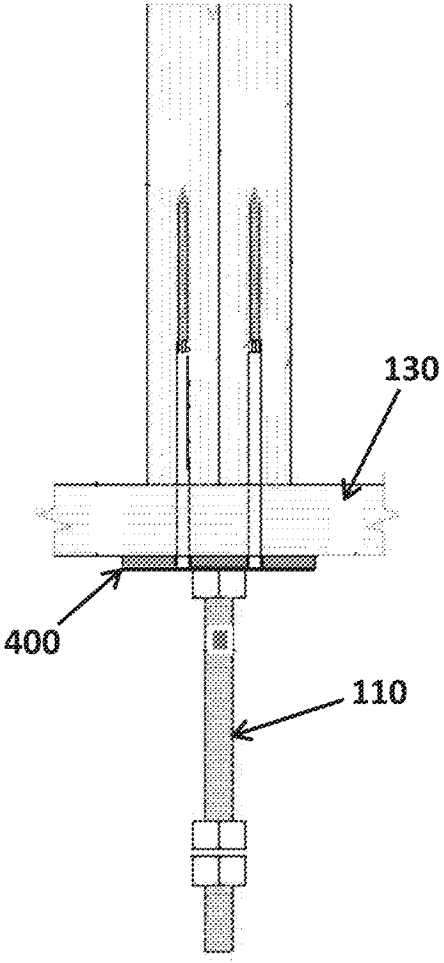
FIG. 6A shows a side view of an alternate embodiment of the improved anchor bolt apparatus incorporating a center plate.
Figure 7B:
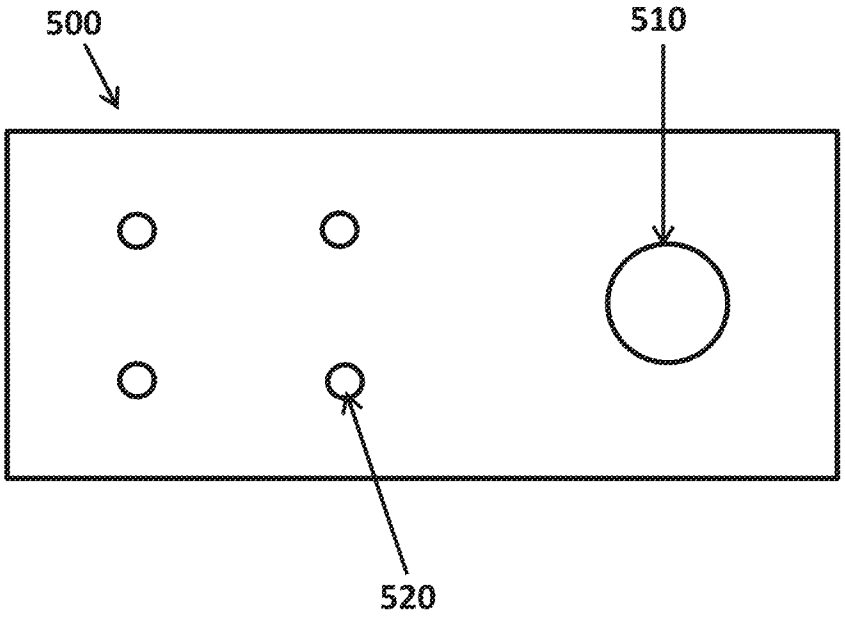
FIG. 7B shows a top view of the off-set plate of the alternate embodiment of FIG. 7A.
Figure 7A:
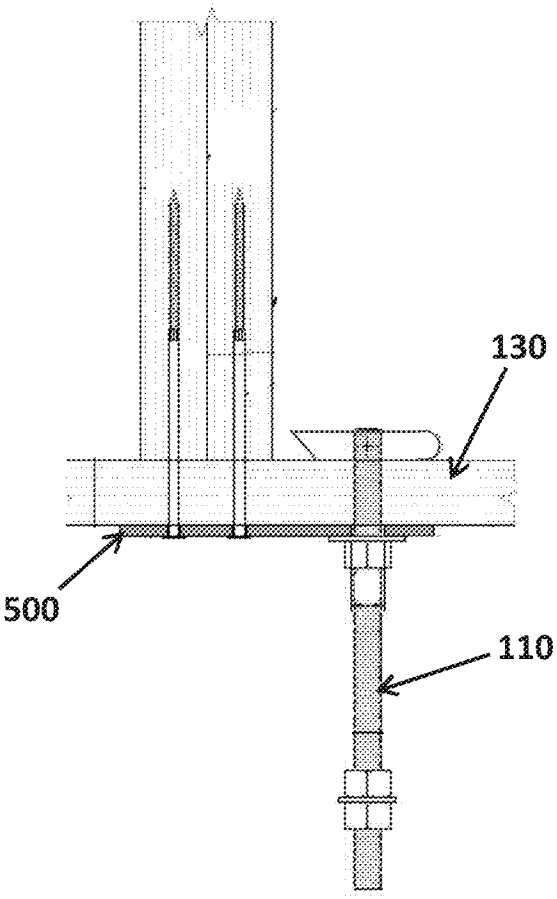
FIG. 7A shows a side view of an alternate embodiment of the improved anchor bolt apparatus incorporating an off-set plate.

In an alternate embodiment, as shown in FIGS. 6A and 6B, a center plate 400 may be incorporated having a main aperture 410 for threaded bolt 110 to pass through along with sub-apertures 420 for support fasteners to pass through. As such the improved anchor bolt apparatus 100 can be used to secure vertical support beams of a housing structure. Furthermore, a modification to this alternate embodiment would be to use an off-set plate 500 having a main aperture 510 for threaded bolt 110 to pass through along with sub-apertures 520 for support fasteners to pass through, as shown in FIGS. 7A and 7B. As such the improved anchor bolt apparatus 100 can be used to secure vertical support beams of a housing structure that are off-set from where the improved anchor bolt apparatus 100 needs to be placed. Furthermore, as shown in FIGS. 6A, 6B, 7A, and 7B, a second nut 150 can be incorporated along with nut 150 and washer 140 to thereby sandwich washer 140 therebetween and securely hold it at a chosen location upon threaded bolt 110 before cement is added and the anchor bolt set within the foundation of the structure.

Figure 8B:
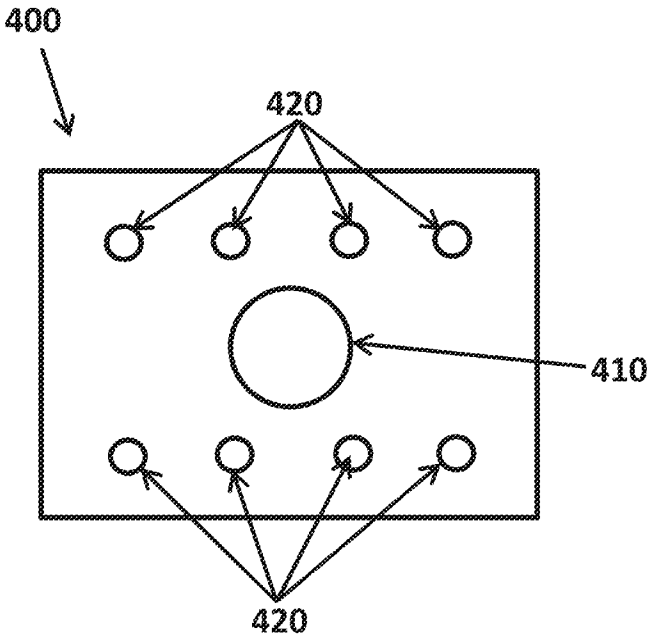
FIG. 8B shows a top view of the center plate with 8 holes of the alternate embodiment of FIG. 8A.
Figure 8A:
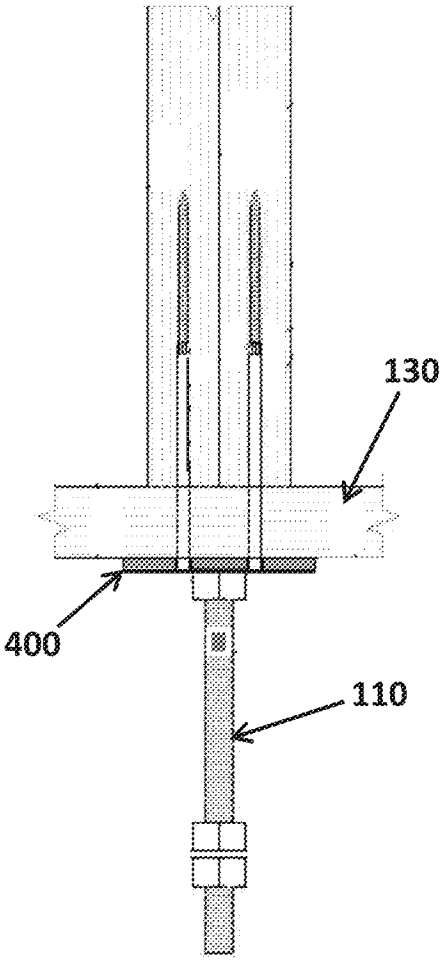
FIG. 8A shows a side view of an alternate embodiment of the improved anchor bolt apparatus incorporating a center plate with 8 holes.

In an alternate embodiment, as shown in FIGS. 8A and 8B, center plate 400 may be incorporated having a threaded main aperture 410 for receiving threaded bolt 110 to pass through along with eight sub-apertures 420 for support fasteners to pass through. As such the improved anchor bolt apparatus 100 can be used to secure vertical support beams of a housing structure with increased rigidity and stability. As compared to the previous embodiment shown in FIGS. 6A and 6B, the four additional holes/sub-apertures 420 are adapted to respectively receive either eight 4-inch screws or six 6-inch screws depending on the materials and dimensions of the structure this embodiment is being applied to.

The improved anchor bolt apparatus 100 may be made from Stainless steel 304, Medical Use 316, low carbon steel, standard steel, galvanized steel, bronze, and any other type of alloy or blended metals. Other materials for manufacture the improved anchor bolt apparatus may include Glass Fiber Reinforced Polymer (GFRP), and plastics.

The most widely used size of the threaded bolt 110 of the improved anchor bolt apparatus 100 for building construction foundation repairs would be stainless steel ⅝" in diameter by 8", 10", 12", 14", 16", for foundation anchoring applications. All sizes should be considered in Standard American English (SAE), and Metric diameters and lengths.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

What is claimed is:

1. An anchor bolt apparatus comprising:

a threaded bolt;

wherein said threaded bolt includes an aperture therethrough at a proximal end thereof;

a pin;

wherein said pin is adapted to be placed within said threaded bolt;

a blade;

wherein said blade is adapted to be pivotally connected to said pin;

a washer;

wherein said washer is adapted to be placed upon said threaded bolt at a distal end thereof;

a nut;

wherein said nut is adapted to be placed upon and engage said washer and threaded distal end of said threaded bolt; and a center plate including:

a main aperture;

wherein said main aperture is located in a center portion of said center plate and is adapted to allow said threaded bolt to pass therethrough; and eight spaced sub-apertures;

wherein four of said eight spaced sub-apertures are linearly aligned and located in a on a first side portion of said center plate, and wherein four of said eight spaced sub-apertures are linearly aligned and located in a second side portion of said center plate opposite from said first side; and wherein said eight spaced sub-apertures are adapted to allow threaded fasteners to pass therethrough;

wherein when in use said main aperture of said center plate is aligned with a pre-formed aperture of a structural element of a house, then said center plate is attached to said structural element via said threaded fasteners passing through respective spaced said sub-apertures, then said threaded bolt is inserted through said main aperture of said center plate and said pre-formed aperture of said structural element until said proximal end of said threaded bolt is located above said structural element, then said blade is rotated about said pin and into a position adapted to engage a top surface of said structural element, such that when said washer and said nut are placed upon said distal end of said threaded bolt they are adapted to be embedded within a foundation of said house and are adapted to create tension upon said threaded bolt and hold said structural element of said house securely to said foundation; and a viewing box including:

a main body;

wherein said main body is adapted to be placed within said foundation of said house and form an interior volume therein; and an aperture;

wherein said aperture is located through a top portion of said main body and adapted to allow said threaded distal end of said threaded bolt to pass therethrough and into said interior volume;

wherein when in use said viewing box is adapted to be removably placed within said foundation of said house; then said threaded bolt is adapted to be inserted into said aperture of said structural element of said house and through said aperture of said viewing box, such that said distal end of said threaded bolt is located within said interior volume of said viewing box and said proximal end of said threaded bolt is adapted to be located above said structural element; then said blade is rotated about said pin and into a position adapted to engage a top surface of said structural element; then said washer and said nut are placed upon said distal end of said threaded bolt and tightened to create tension upon said threaded bolt.

2. The anchor bolt of claim 1, wherein said anchor bolt apparatus is made from a material chosen from a list of materials consisting of stainless steel, low carbon steel, standard steel, galvanized steel, bronze, plastics, glass fiber reinforced polymer, and any alloy or combination thereof.

3. The anchor bolt of claim 1, wherein a diameter of said threaded bolt is ⅝ of an inch, and a length is between 8 inches and 16 inches.

4. The anchor bolt of claim 1, wherein a length of said blade is larger than a diameter of said threaded bolt.

5. The anchor bolt of claim 1, wherein said blade is formed having a substantially flat rectangular shape and a rectangular cross-section.

6. The anchor bolt of claim 1, wherein said main aperture of said center plate is threaded and adapted to interdigitate with threads of said threaded bolt.

7. A combination of a foundation of a house and an anchor bolt apparatus, comprising:

said foundation of said house including:

a support material; and a structural element including:

a pre-formed aperture;

wherein said pre-formed aperture extends through said structural element;

wherein said structural element is located upon a top surface of said support material; and said anchor bolt apparatus comprising:

a threaded bolt;

wherein said threaded bolt includes an aperture therethrough at a proximal end thereof;

a pin;

wherein said pin is adapted to be placed within said threaded bolt;

a blade;

wherein said blade is adapted to be pivotally connected to said pin;

a washer;

wherein said washer is adapted to be placed upon said threaded bolt at a distal end thereof;

a nut;

wherein said nut is adapted to be placed upon and engage said washer and threaded distal end of said threaded bolt; and a center plate including:

a main aperture;

wherein said main aperture is located in a center portion of said center plate and is adapted to allow said threaded bolt to pass therethrough; and eight spaced sub-apertures;

wherein four of said eight spaced sub-apertures are linearly aligned and located in a on a first side portion of said center plate, and wherein four of said eight spaced sub-apertures are linearly aligned and located in a second side portion of said center plate opposite from said first side; and wherein said eight spaced sub-apertures are adapted to allow threaded fasteners to pass therethrough;

wherein when in use said main aperture of said center plate is aligned with said pre-formed aperture of said structural element of said house, then said center plate is attached to said structural element via said threaded fasteners passing through respective spaced said sub-apertures, then said threaded bolt is inserted through said main aperture of said center plate and said pre-formed aperture of said structural element until said proximal end of said threaded bolt is located above said structural element, then said blade is rotated about said pin and into a position adapted to engage a top surface of said structural element, such that when said washer and said nut are placed upon said distal end of said threaded bolt they are adapted to be embedded within said foundation of said house and are adapted to create tension upon said threaded bolt and hold said structural element of said house securely to said foundation; and a viewing box including:

a main body;

wherein said main body is adapted to be placed within said foundation of said house and form an interior volume therein; and an aperture;

wherein said aperture is located through a top portion of said main body and adapted to allow said threaded distal end of said threaded bolt to pass therethrough and into said interior volume;

wherein when in use said viewing box is adapted to be removably placed within said foundation of said house; then said threaded bolt is adapted to be inserted into said aperture of said structural element of said house and through said aperture of said viewing box, such that said distal end of said threaded bolt is located within said interior volume of said viewing box and said proximal end of said threaded bolt is adapted to be located above said structural element; then said blade is rotated about said pin and into a position adapted to engage a top surface of said structural element; then said washer and said nut are placed upon said distal end of said threaded bolt and tightened to create tension upon said threaded bolt.

8. The combination of claim 7, wherein said anchor bolt apparatus is made from a material chosen from a list of materials consisting of stainless steel, low carbon steel, standard steel, galvanized steel, bronze, plastics, glass fiber reinforced polymer, and any alloy or combination thereof.

9. The combination of claim 7, wherein a diameter of said threaded bolt is ⅝ of an inch, and a length is between 8 inches and 16 inches.

10. The combination of claim 7, wherein a length of said blade is larger than a diameter of said threaded bolt.

11. The combination of claim 7, wherein said blade is formed having a substantially flat rectangular shape and a rectangular cross-section.

12. The combination of claim 7, wherein said main aperture of said center plate is threaded and adapted to interdigitate with threads of said threaded bolt.

* * * * *